US005315770A

United States Patent [19]

Campbell

[11] Patent Number: 5,315,770

[45] Date of Patent: May 31, 1994

[54] ROADWAY TRENCHING APPARATUS

[75] Inventor: Thomas R. Campbell, Chattanooga, Tenn.

[73] Assignee: Astec Industries, Inc., Chattanooga, Tenn.

[21] Appl. No.: 991,372

[22] Filed: Dec. 15, 1992

[51] Int. Cl.[5] ..... E02F 5/08

[52] U.S. Cl. ..... 37/96; 37/94; 37/91; 37/190

[58] Field of Search ..... 37/305, 304, 306, 351, 37/355, 357, 359, 360, 361, 362, 91, 94, 95, 96, 97, 107, 104, 105, 190, 463, 464, 462; 171/16; 404/91, 96, 104

[56] References Cited

U.S. PATENT DOCUMENTS

| | | | |
|---|---|---|---|
| 2,188,989 | 2/1940 | Werner | 37/305 X |
| 2,748,505 | 6/1956 | Turner | 37/96 |
| 3,050,879 | 8/1962 | Brown | 37/305 |
| 3,560,050 | 2/1971 | Lockwood . | |
| 3,690,023 | 9/1972 | Peterson | 37/360 |
| 3,767,262 | 10/1973 | Pentith . | |
| 3,767,264 | 10/1973 | Eckey . | |
| 3,895,843 | 7/1975 | Wall et al. . | |
| 4,069,605 | 1/1978 | Satterwhite | 37/91 X |
| 4,139,318 | 2/1979 | Jakob et al. . | |
| 4,186,968 | 2/1980 | Barton . | |
| 4,193,636 | 3/1980 | Jakob . | |
| 4,342,485 | 8/1982 | Tuneblom . | |
| 4,563,826 | 1/1986 | Whitaker, Jr. | 37/97 |
| 4,713,898 | 12/1987 | Bull et al. | 37/104 X |
| 4,755,001 | 7/1988 | Gilbert | 37/357 X |
| 4,785,560 | 11/1988 | Hanson | 37/96 X |
| 4,794,709 | 1/1989 | Rivard | 37/94 |
| 4,797,025 | 1/1989 | Kennedy . | |
| 4,826,352 | 5/1989 | Wirtgen . | |
| 4,900,094 | 2/1990 | Sergeant . | |
| 5,029,649 | 7/1991 | Kershaw et al. | 37/107 X |
| 5,058,294 | 10/1991 | Bryan, Jr. | 37/94 X |
| 5,078,540 | 1/1992 | Jakob et al. . | |
| 5,116,162 | 5/1992 | Burhite . | |
| 5,199,195 | 4/1993 | Scordilis et al. | 37/91 X |
| 5,228,220 | 7/1993 | Bryan, Jr. | 37/359 X |

*Primary Examiner*—Randolph A. Reese
*Assistant Examiner*—J. Russell McBee
*Attorney, Agent, or Firm*—Nilles & Nilles

[57] ABSTRACT

A self propelled apparatus for digging a shallow trench along one side of a roadway is disclosed, and which is useful as part of a roadway widening operation. The apparatus comprises a cutter drum mounted to one side of the chassis of the apparatus, and a conveyor belt is mounted to the same side of the chassis with an inlet end positioned immediately adjacent the cutter drum and an elevated outlet end positioned beyond the forward end of the chassis. An enclosure surrounds the cutter drum so that the drum may be rotated in a downwardly cutting direction, and the loosened soil or other material may be lifted and guided around the drum and deposited onto the conveyor. The cutter drum includes one or more extensions which may be coaxially mounted thereto, so as to permit the width of the cutter drum and thus the width of the resulting trench to be selectively varied.

29 Claims, 7 Drawing Sheets

32
36
40
41
30
90
82
86
88
58
60
94
97
95
96
99
44
45
110
47
97
81
90
31
56
57
64
30a
46
101
11
34
37
35
10
12

ROADWAY TRENCHING APPARATUS

BACKGROUND OF THE INVENTION

The present invention relates to a self propelled apparatus for digging a shallow trench along one side of an existing roadway, and which is useful as part of a roadway widening operation.

Roadway planing machines are known which are adapted for removing the surface of the roadway and conveying the removed material to the bed of an adjacent truck. Such planing machines typically include a rotatable cutter drum having a plurality of teeth mounted on its surface and which is adapted for removing a thickness of the asphalt paving, note for example U.S. Pat. Nos. 5,078,540; 4,193,636; and 4,139,318. While these prior planing machines are suitable for their intended purpose, they are not capable of digging a trench along the side of an existing roadway as part of a roadway widening operation, since in most cases the central location of the cutter drum renders it impossible to align the drum along the side of the roadway by reason of inadequate room along the shoulders of the roadway. In addition, most widening trenches are more narrow and deeper than the cutter drums are capable of digging.

It is accordingly an object of the present invention to provide a roadway trenching apparatus which is capable of effectively and efficiently digging a trench along the side of an existing roadway, and removing the soil or other material from the trench and delivering the same to the bed of an accompanying truck or placing the material at the side of the newly cut trench.

It is also an object of the present invention to provide a roadway trenching apparatus which forms a trench with a square edge along the side of an existing roadway, so as to provide a square joint between the existing roadway and new roadway extension.

It is a further object of the present invention to provide a roadway trenching apparatus which is capable of being readily modified to provide a trench of any one of several selected widths.

It is still another object of the present invention to provide a roadway trenching apparatus which is capable of providing a selected depth in the trench being formed, and which has provision for elevation and grade control of the trench.

SUMMARY OF THE INVENTION

The above and other objects and advantages of the present invention are achieved in the embodiment illustrated herein by the provision of an apparatus which comprises a chassis which defines a perimeter which includes front and rear ends, and opposite sides. The chassis further defines a longitudinal centerline extending between said front and rear ends. A plurality of wheel assemblies are mounted to the chassis for permitting movement along the ground.

The apparatus also includes a cutter drum which is mounted to the chassis so as to be positioned adjacent one of the opposite sides thereof and at least essentially outside of the perimeter of said chassis. Also, the cutter drum is mounted for rotation about a generally horizontal axis which extends between the opposite sides of the chassis and so as to be adapted to engage and dig into the ground surface. A prime mover is mounted to the chassis for advancing the apparatus in a forward direction along the ground surface and for rotating the cutter drum about the horizontal axis. Also, a conveyor is mounted along the same side of said chassis and it has an inlet end positioned immediately adjacent the cutter drum and an elevated outlet end positioned beyond the front end of the chassis, and an enclosure encloses the cutter drum so that the soil or other material which is loosened and removed by the rotating cutter drum is deposited onto the inlet end of the conveyor and discharged at the outlet end thereof.

In the preferred embodiment, the cutter drum mounts a plurality of spaced apart cutting teeth, and the drum is rotated so that the teeth move downwardly into the undisturbed ground surface forwardly of the drum, and such that the lowermost portion of the drum moves in a rearward direction. This assists in moving the apparatus in the forward direction, and in addition, the loosened soil or other materials are guided about the cutter drum in its direction of rotation and deposited onto the conveyor, which is preferably positioned forwardly of the drum.

Also, in the preferred embodiment, the cutter drum comprises a cylindrical main body portion which is mounted to the chassis for rotation about the horizontal axis, and a cylindrical extension which has a diameter corresponding to that of the main body portion. The extension is adapted to be releasably mounted to the main body portion so as to be coaxially aligned, and such that the width of the cutter drum may be adjusted by the addition or removal of the extension.

To accommodate the addition of the extension to the main body portion of the cutter drum, the enclosure includes a main housing portion which is fixedly mounted to one of the sides of the chassis, and a housing extension which is releasably mounted to the outer side plate of the main housing portion when the extension of the cutter drum is mounted to the main body portion thereof.

The apparatus of the present invention also preferably includes means mounting the wheel assemblies to the chassis so as to permit vertical adjustment of the height of the chassis above the ground surface, and thus the adjustment of the depth of the trench formed by the cutter drum.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figures 1, 2, 3:
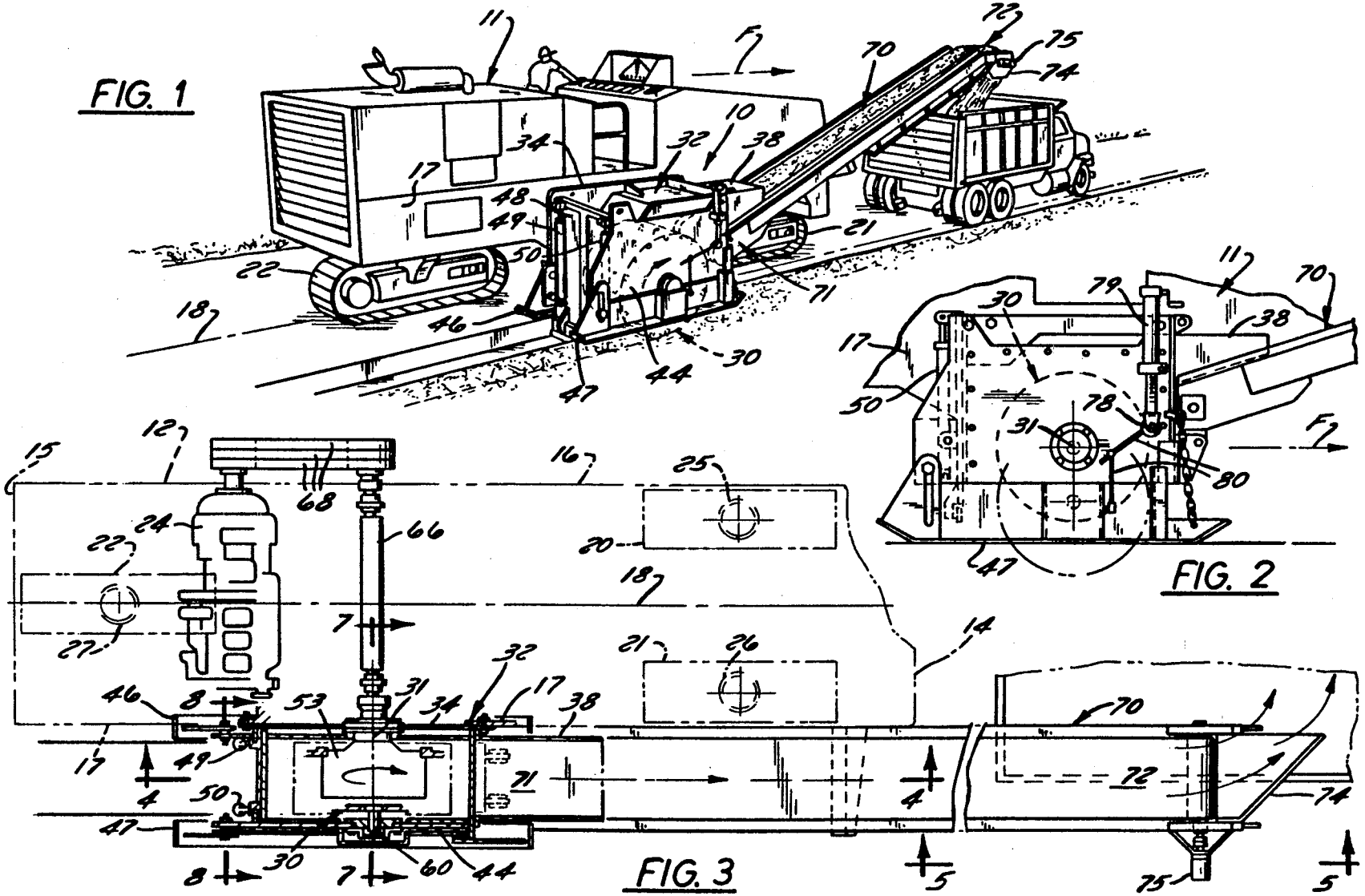
FIG. 1 is a perspective view of a roadway trenching apparatus which embodies the features of the present invention.
FIG. 2 is a fragmentary side elevation view of the housing which encloses the cutter drum of the apparatus of FIG. 1.
FIG. 3 is a schematic top plan view of the apparatus and particularly illustrating the cutter drum and conveyer in partial cross section.

Referring more particularly to the drawings, FIG. 1 illustrates an apparatus generally at 10 and which embodies the features of the present invention. In the illustrated embodiment, the apparatus comprises a chassis 11 which defines a perimeter 12 in plan view (note FIG. 3), and which includes front and rear ends 14, 15, and opposite sides 16, 17. Also, the perimeter 12 defines a longitudinal centerline 18 which extends between the front end 14 and the rear end 15.

The chassis 11 is supported by three ground engaging wheel assemblies in the illustrated embodiment, which take the form of conventional tracks 20, 21, 22. As is conventional, the three tracks may all be steerable to provide precise directional control. Also, the tracks may be driven by hydraulic motors (not shown) which are in turn powered by a prime mover, such as the internal combustion engine 24 as seen in FIG. 3. The tracks are mounted to the chassis 11 by means of double acting elevation cylinders 25, 26, 27 (FIGS. 3 and 4), which permit the height of the chassis 11 above the ground surface be adjusted, compare for example FIGS. 7A and 7B.

Figure 4:
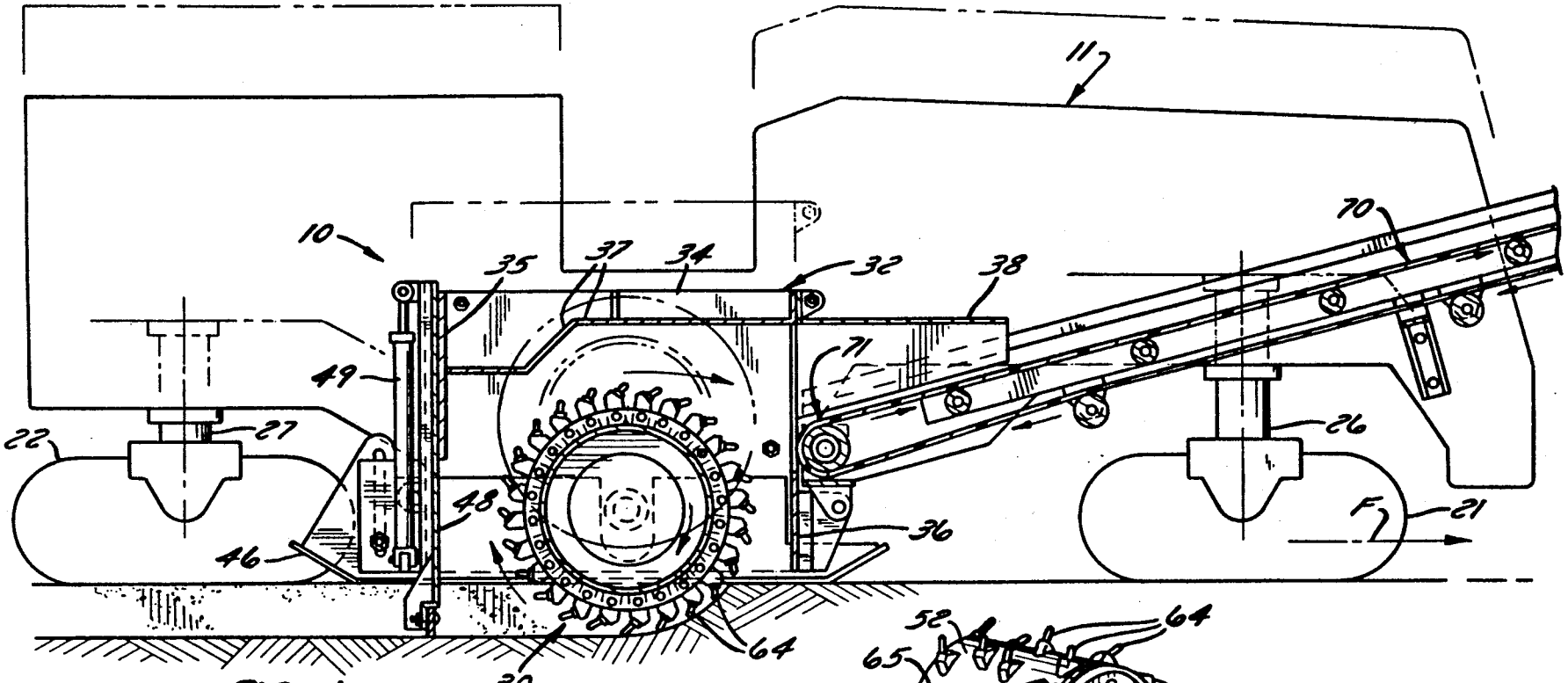
FIG. 4 is a sectioned and partially schematic side elevation view illustrating the cutter drum of the apparatus and the elevation control therefor.

The apparatus of the present invention further includes a cutter drum 30 which is mounted to the side 17 of the chassis, and for rotation about a generally horizontal axis 31 which extends between the sides 16, 17. A housing 32 encloses the cutter drum 30, and the housing 32 includes an inner side plate 34 which is fixed to the side 17 of the chassis 11 so as to be disposed in a generally vertical plane which is parallel to the centerline 18 of the apparatus. The housing 32 further includes a rear plate 35 (FIG. 4) which covers only the upper portion of the rear of the housing, a front plate 36 which covers only the lower portion of the front of the housing, and a number of top plates 37 which are fixed to the inner side plate 34 so as to generally enclose the top portion of the cutter drum. A transition hood 38 extends forwardly from the front of the housing 32 and above the front plate 36 as best seen in FIG. 4, and for the proposes described below.

The housing 32 for the cutter drum 30 further includes an outer side plate 40 (FIG. 9) which is fixed to the outer edges of the plates 35, 36, 37, so as to be parallel with the inner side plate 34. The outer side plate 40 has an inverted U-shaped opening 41 therein which is sized to lie outside the circumference of the cutter drum 30 when viewed in side elevation. Also, an end plate 44 is bolted to the outside of the outer side plate 40 so as to cover the opening 41, and the end plate 44 mounts a sleeve bearing 45.

The lower edge of the inner side plate 34 mounts a ski 46 which is free to float vertically a predetermined distance with respect to the housing, and the lower edge of the end plate 44 mounts a similar ski 47. These skis serve to enclose the lower portion of the cutter drum during movement over uneven terrain, and they are also useful as part of the grade control system as further described below.

Figure 8B:
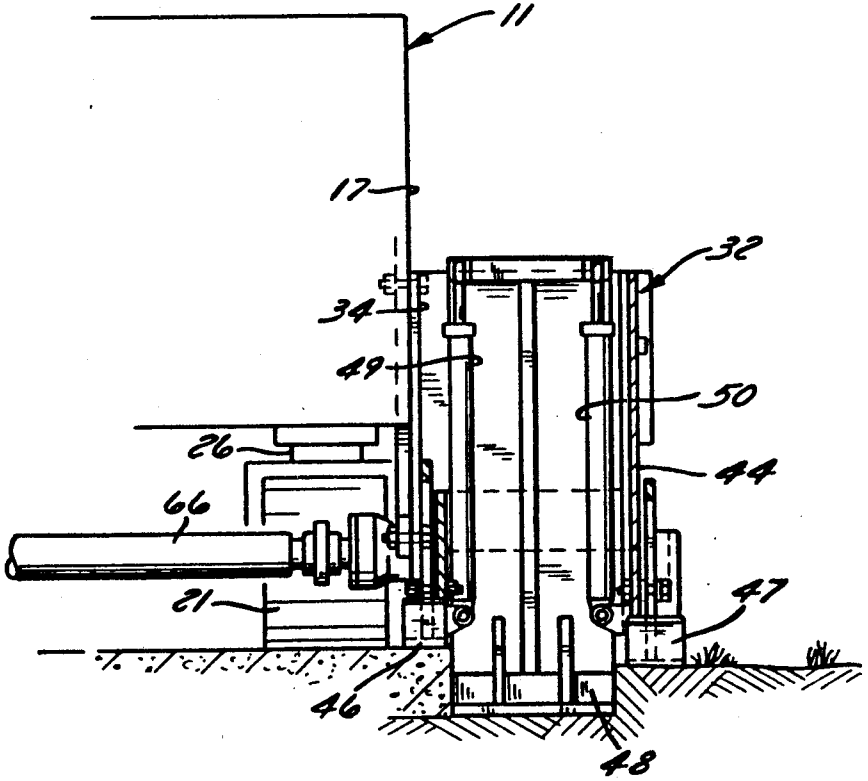
FIGS. 8A and 8B are fragmentary end views of the housing of the cutter drum and illustrating the cutter drum and rear mold board in an elevated position in FIGS. 8A, and in a lowered position in FIG. 8B.
Figure 8A:
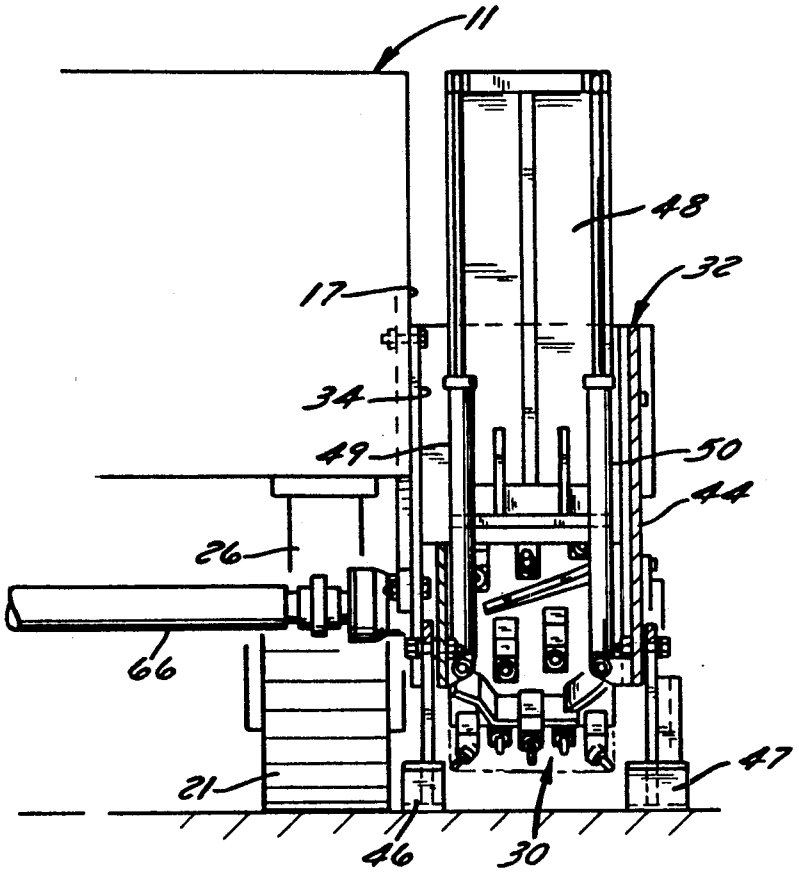

The rear side of the housing mounts a vertically moveable mold board 48 (FIGS. 4, 8A, and 8B) so as to be adjacent and parallel to the rear plate 35, and the mold board 48 is movable vertically by means of two hydraulic cylinders 49, 50. Thus the mold board 48 may be elevated to permit access to the cutter drum as seen in FIG. 8A, or it may be biased downwardly into contact with the bottom of the trench being formed, during operation of the apparatus and as seen in FIGS. 4 and 8B.

Figure 6:
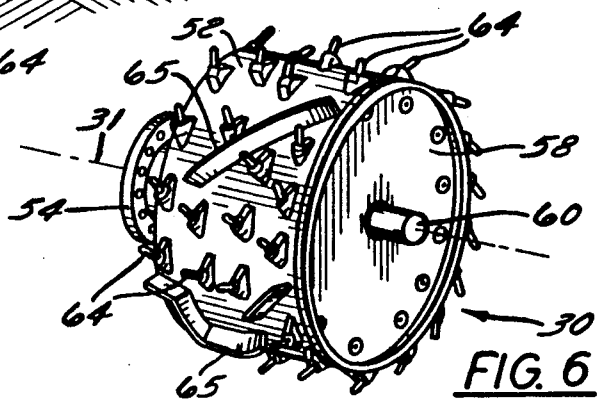
FIG. 6 is a fragmentary perspective view of the cutter drum of the apparatus.
Figure 5:
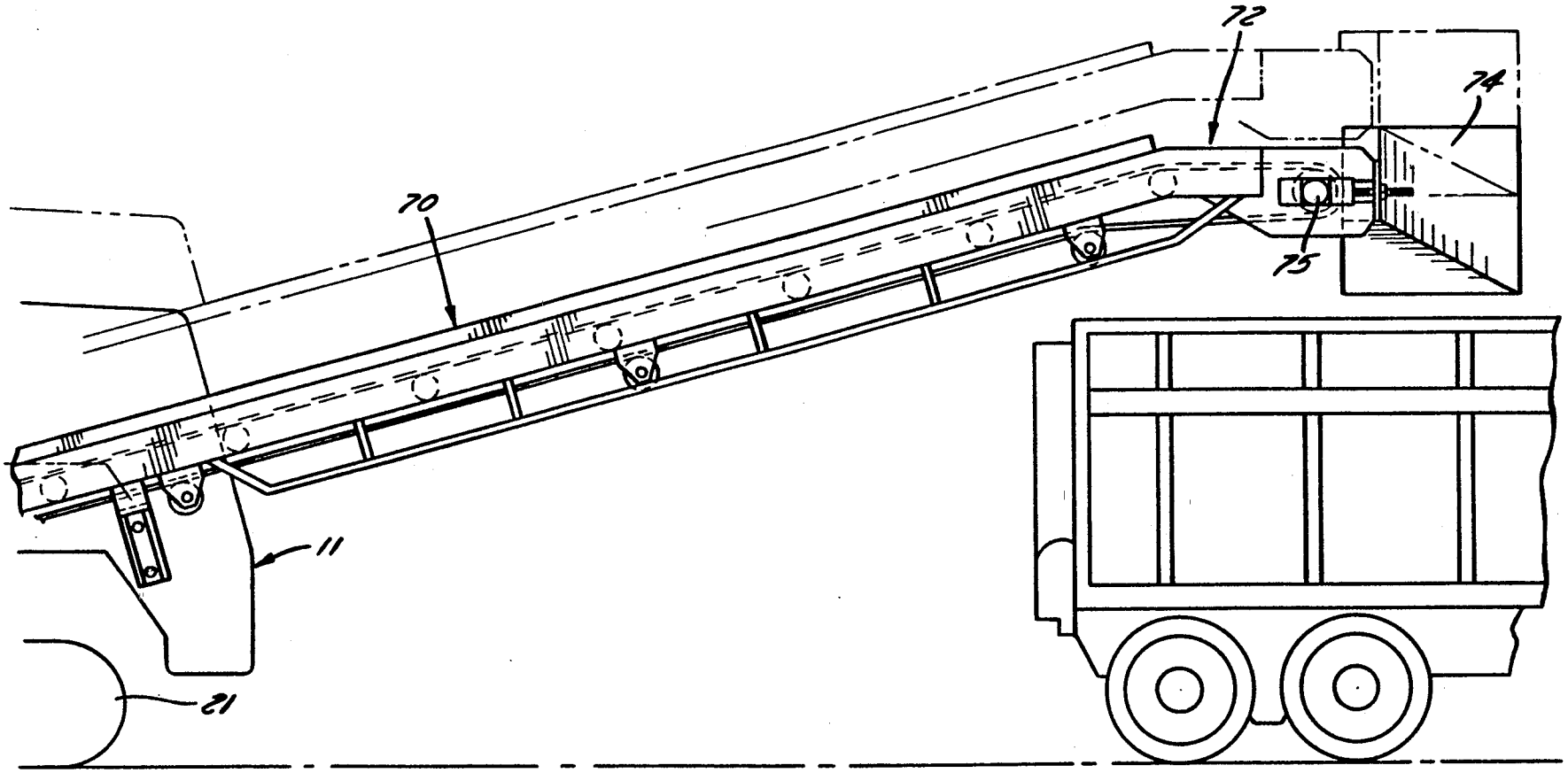
FIG. 5 is a side elevation view illustrating the forward end portion of the conveyer and the deflector positioned at the forward end thereof.
Figure 10:
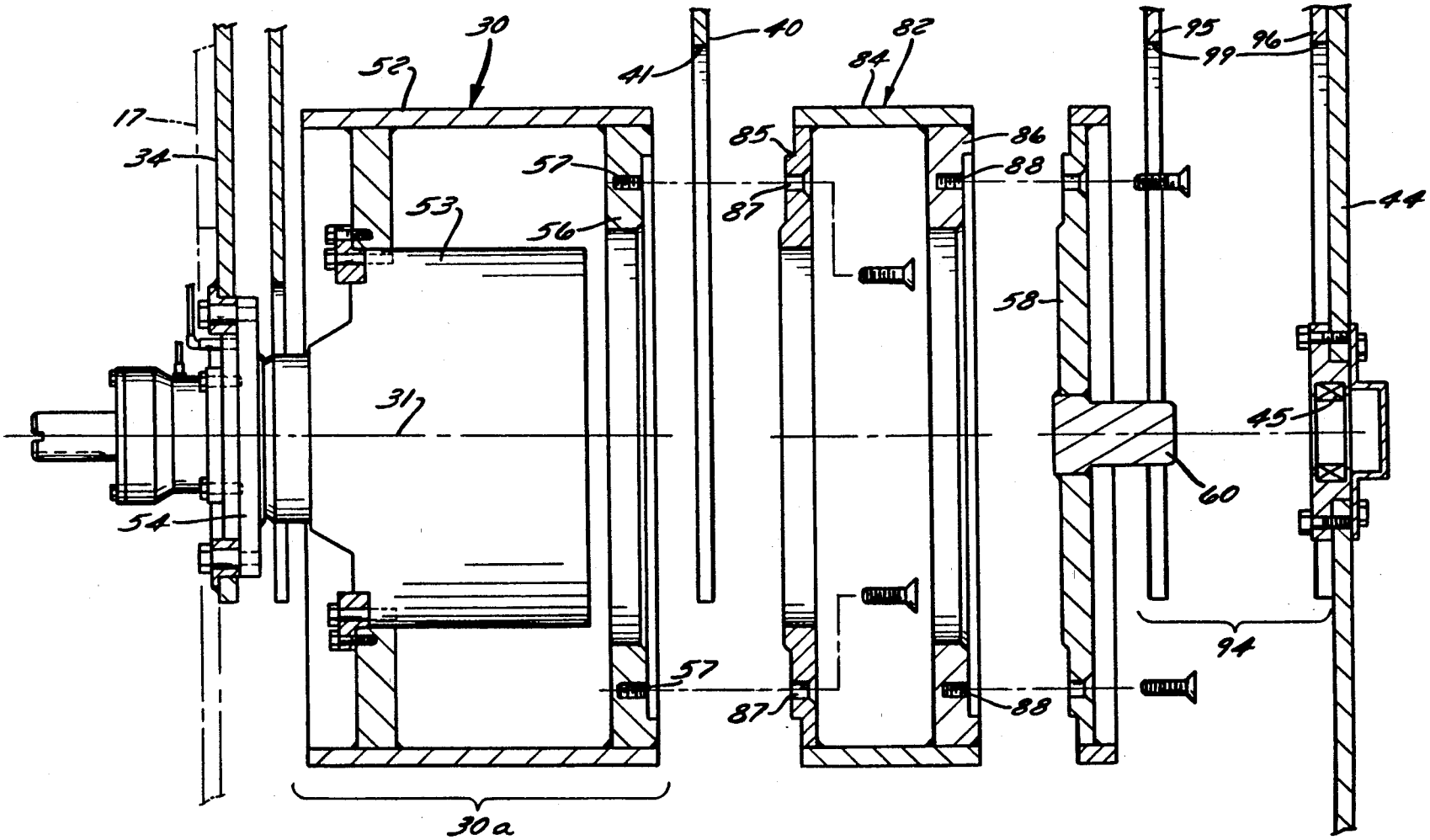
FIG. 10 is an exploded and sectioned end elevation view of the main body portion and the extension of the cutter drum, as well as the main housing portion and its extension.

As best seen in FIGS. 6 and 10, the cutter drum 30 is in the form of a hollow cylindrical sleeve 52, which mounts a planetary speed reduction gear 53 coaxially therein. The reduction gear 53 in turn mounts a mounting flange 54 which is fixed to the inner side plate 34 of the housing by bolts, and the inner side plate of the housing is in turn bolted to the side 17 of the chassis 11. Thus the elevation of the cutter drum 30 is fixed with respect to the elevation of the chassis 11.

The outside end of the sleeve 52 of the cutter drum 30 includes an internal mounting ring 56 having a number of threaded openings 57, and the sleeve 52 is closed by means of a cover plate 58, which is removably attached to the mounting ring 56 by means of bolts which engage the threaded openings 57. Also, the cover plate 58 mounts a coaxial bearing shaft 60 which is rotatably supported in the bearing sleeve 45 which is mounted to the outer end plate 44 of the housing.

The cutter drum 30 further includes a plurality of spaced apart cutting teeth 64 mounted on the exterior of the sleeve, as well as a number of transverse flights 65 which serve to lift and convey the loosened soil as further described below. The drum typically has a diameter of about 56 inches, measured to the tips of the teeth 64.

The cutter drum 30 is operatively connected to the engine 24, via the horizontal drive shaft 66 which is connected to the gear reducer 53, note FIG. 3. A plurality of drive belts 68 extend between the output of the engine 24 and the opposite end of the drive shaft for imparting rotation to the drive shaft and thus the cutter drum 30 via the gear reducer 53.

The apparatus of the present invention further includes a conveyor 70, which is mounted to the side 17 of the chassis 11, and which includes an inlet end 71 positioned immediately forwardly of the cutter drum 30 and below the transition hood 38, and an elevated outlet end 72 positioned beyond the front end 14 of the chassis. A deflector 74 is mounted at the outlet end of the conveyor for deflecting the material being conveyed laterally toward the centerline 18 to thereby facilitate delivery into the bed of a trunk which is moving along the roadway in front of the apparatus 10 as been in FIG. 1. Alternatively, a deflector of opposite hand may be employed which serves to deflect the removed material to form a windrow along one side of the trench. The conveyor 70 is powered by a hydraulic motor 75 (FIG. 1) which is in turn powered by the engine 24.

Figure 7B:
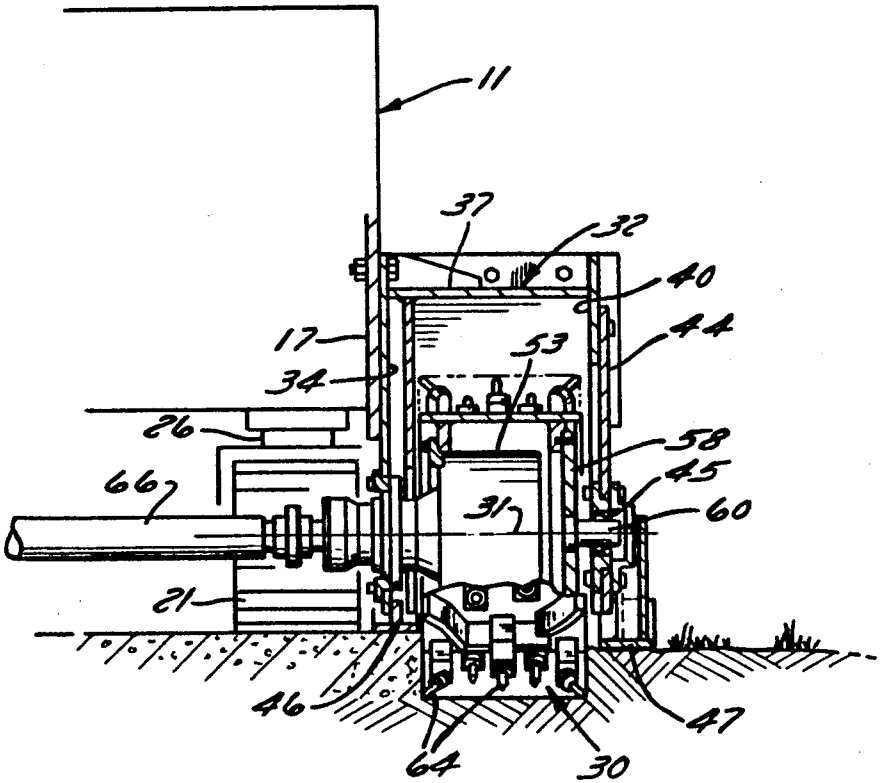
FIGS. 7A and 7B are fragmentary and sectioned end views of the cutter drum at elevated and lowered elevations respectively.

As illustrated in FIG. 2, one of the skis 46, 47 may be utilized as part of the elevation and slope control systems of the apparatus. A sensing unit as illustrated in FIG. 2 comprises a hydraulic rotary sensor 78 which is mounted to a grade jack 79. The jack 79 is mounted to the chassis and by operation of the jack, the sensor 78 may be raised and lowered. A number of pivotally interconnected rods 80 extend from one of the skis 46, 47 to the rotary sensor 78, such that any elevation change of the ski with respect to the chassis is noted by a rotation of the sensor 78. A similar ski and sensor (not shown) are mounted on the opposite side 16 of the chassis, and signals from the two sensors are delivered to a central control panel, by which the elevation of selected tracks may be adjusted, and so as to permit accurate depth of cut and grade control. On the cutter drum side 17, it is preferred to connect the sensor 78 to the inside ski 46, i.e. the ski attached to the inner side plate 34 of the housing and which normally rides on the pavement as best seen in FIGS. 7B and 8B.

The above described depth of cut and grade control systems are conventional in other roadway processing machines, and are further described for example in the above cited U.S. Pat. No. 4,139,318, the disclosure of which is expressly incorporated herein by reference.

Figure 7A:
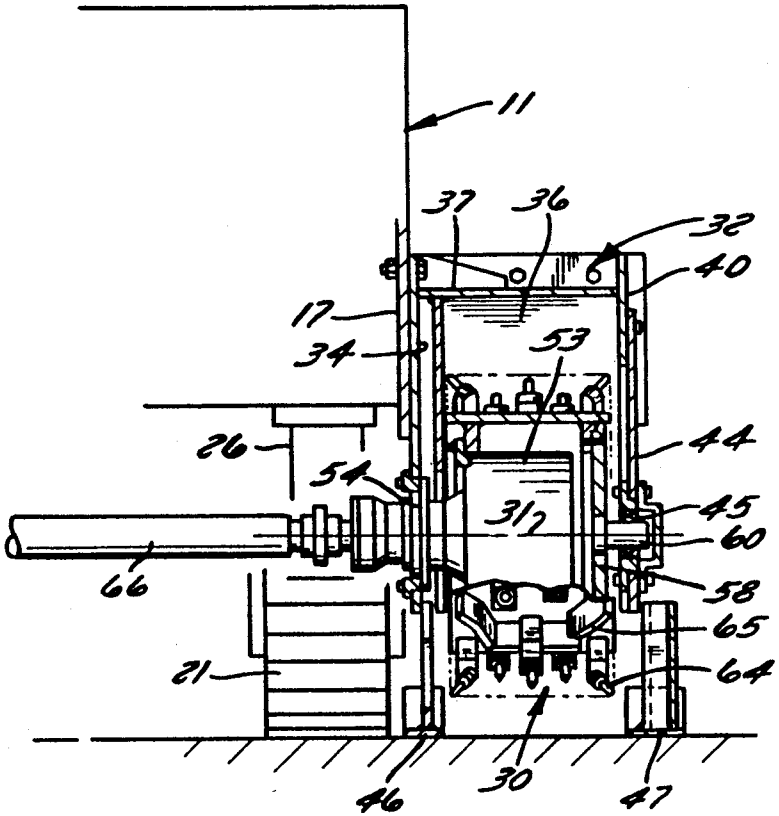

In operation, the apparatus 10 may be transported under its own power to the job site, with the chassis 11 and thus the cutter drum 30 elevated as seen in FIG. 7A. When positioned for operation, the cutter drum 30 is rotated and the chassis 11 is then lowered to a predetermined elevation so that the cutter drum enters into the ground surface as seen in FIG. 7B. The apparatus 10 then advances forwardly in the direction of the arrow F (FIGS. 1 and 4) at a speed of between about 20 to 100 feet per minute, depending on the nature of the ground material being removed. Also, the cutter drum is rotated about its axis at a rotational speed which is typically between about 85–95 rpm, and in a direction such that the teeth 64 move downwardly into the undisturbed ground surface which is forwardly of the drum. Thus the lowermost portion of the drum 30 will be seen to move in a rearward direction. This rotational direction serves to help propel the apparatus in the forward direction F, and in addition, the rotational direction and the inside configuration of the housing 32 serves to guide and convey the loosened soil or other material about the periphery of the drum so that it is thrown through the transition hood 38 and deposited onto the upper run of the conveyor 70, note particularly FIG. 4. The soil or other material is then conveyed forwardly by the conveyor, and at the outlet end 72 it is deflected laterally toward the centerline 18 by the deflector 74. A truck is preferably positioned forwardly of the apparatus as seen in FIG. 1 to receive the discharged soil as the machine slowly advances and forms a continuous shallow trench along the side of the roadway.

Rotation of the drum in the downcutting direction as described above is preferred since it permits the elevation of the inlet end 71 of the conveyor 70 to be relatively high, and thus the maximum depth of the trench may be relatively deep. However, an upcutting direction is possible, where the drum lifts the loosened soil onto the inlet end of the conveyor, but this arrangement requires that the inlet end be lowered as compared to its position as shown in the illustrated embodiment, and thus the maximum depth of the trench would be reduced.

Figure 9:
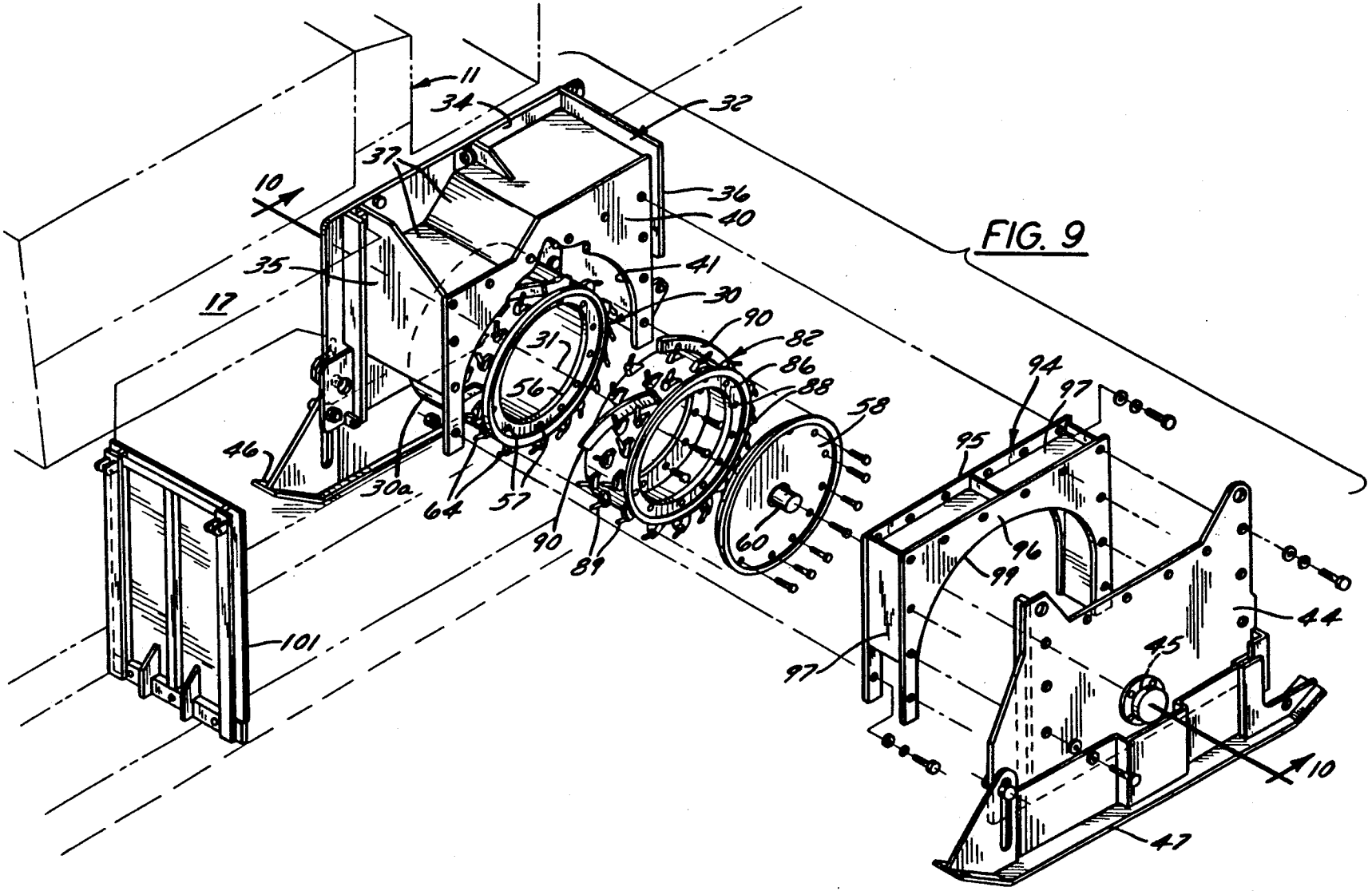
FIG. 9 is an exploded perspective view illustrating the main body portion and extension of the cutter drum, as well as the main housing portion and its extension, and which permits the width of the cutter drum and the resulting trench to be changed.

One of the advantageous features of the illustrated embodiment of the apparatus is the fact that the width of the cutter drum 30 may be effectively varied so as to permit the width of the resulting trench to be varied. In this embodiment, and as best seen in FIGS. 9 and 10, the cutter drum comprises a main body portion 30*a* which corresponds structurally to the drum 30 as described above, and an extension 82. The extension 82 comprises a tubular sleeve 84 which has a diameter which corresponds to that of the main body portion 30*a*, and the interior of the sleeve 84 of the extension 82 mounts a pair of annular mounting rings 85, 86. The innermost ring 85 includes a plurality of openings 87 which are aligned with the threaded openings 57 of the ring 56 of the main body portion 30*a*. Also, the outermost ring 86 includes a plurality of threaded openings 88 which conform to the threaded openings 57 of the ring 56 in the main body portion 30*a*. The peripheral surface of the extension 82 includes a plurality of spaced apart cutting teeth 89 which conform to those mounted on the main body portion, and the extension 82 also includes a number of helically aligned flights 90 on the exterior surface for the purposes described below.

The housing of this embodiment includes main housing portion 32 as seen in FIG. 9, and a housing extension 94 which comprises a pair of laterally spaced apart and parallel side walls 95, 96 and a number of covering plates 97 mounted between the side walls. Each of the side walls 95, 96 includes an inverted U-shaped opening 99 which conforms to the outline of the opening 41 in the side plate 40 of the main housing portion. The housing of this embodiment also includes a mold board 101 which is similar in construction to that described above at 48, but which is wider.

Adjustment of the width of the cutter drum is effected by first removing the end plate 44 of the housing, by removal of the bolts, and so as to provide access to the main body portion 30*a* of the cutter drum. The cover plate 58 is then removed, and the extension 82 is then releasably mounted to the main body portion 30*a* so as to be coaxially aligned along the horizontal axis. This releasable mounting is effected by aligning the extension 82 with the main body portion 30*a* so that the threaded openings 57 in the ring 56 of the main body portion 30*a* are aligned with the openings 87 in the ring 85 of the extension 82. Bolts may then be positioned so as to extend through the openings 87 in the ring 85 and threaded into the openings 57 of the ring 56. The cover plate 58 then may be attached so as to cover the outer end of the extension, by threading the bolts into the threaded openings 88 in the ring 86.

To complete the conversion to the wider cutter drum, the housing extension 94 is positioned adjacent the outer side plate 40 of the main housing portion, and the end plate 44 is then positioned on the outside of the extension 94 and adjacent the side wall 96 thereof. Elongate bolts are then inserted through the openings in the end plate 44, then through aligned openings in each of the side plates 95, 96 of the extension 94, and finally through the aligned openings in the side plate 40. Suitable nuts may then be joined to the bolts to complete the assembly. When so assembled, the shaft 60 of the cover plate 58 of the cutter drum will again be supportingly received in the bearing sleeve 45 of the end plate 44.

With the additions of the extension 82 to the main body portion 30*a* and the extension 94 to the main housing portion 92 as described above, it will be apparent that the original mold board 48 will be of insufficient width. Accordingly, in accordance with the present invention, the additional mold board 101 of increased width is provided, and when assembled in place of the original mold board, the back wall of the housing will be completely covered.

During operation of the apparatus 10 with the cutter drum being extended in width by the extension 82, it will be understood that the loosened soil or other material is conveyed toward the main body portion 30*a* by the helically aligned flights 90 on the exterior surface of the extension 82. The flights 65 of the main body portion 30*a* then act to lift and convey the loosened material through the transition hood 38 and onto the upper surface of the conveyor 70.

While a single extension 82 for the cutter drum has been illustrated, it will be appreciated that several extensions, each with a different width, may be provided so that the desired width may be readily selected from a relatively large range of available sizes. In addition, two or more of the extensions may be coaxially mounted to the cutter drum and to each other, by the construction described above. The housing may also have a number of extensions to accommodate the use of the various cutter drum extensions.

In the drawings and specification, there has been set forth a preferred embodiment of this invention, and even though specific terms are used, they are used in a generic and descriptive sense only and not for purposes of limitation.

That which is claimed is:

1. A self propelled apparatus for digging a shallow trench and removing the soil therefrom during movement of the apparatus along the ground surface, and comprising a chassis defining front and rear ends, and opposite sides, and further defining a longitudinal centerline extending between said front and rear ends, a plurality of wheel assemblies mounted to said chassis for permitting movement along the ground surface, a cutter drum mounted to said chassis for rotation about a generally horizontal axis and so as to be adapted to engage and dig into the ground surface and form a trench as the apparatus moves forwardly along the ground surface, prime mover means mounted to said chassis for advancing the apparatus in a forward direction and for rotating said cutter drum so that the lowermost portion thereof moves in a rearward direction, conveyor means having an inlet end positioned immediately forwardly of said cutter drum and an elevated outlet end positioned beyond the said front end of the chassis, and enclosure means enclosing said cutter drum so that the soil which is loosened and removed by the rotating cutter drum is guided about said cutter drum and deposited onto said inlet end of said conveyor means and discharged at said outlet end thereof.

2. The apparatus as defined in claim 1 wherein said cutter drum includes a plurality of spaced apart cutting teeth mounted on the peripheral surface thereof, and a plurality of laterally directed flights mounted on the peripheral surface thereof for lifting the loosened soil or other material from the trench being formed and depositing the same onto said conveyor means.

3. The apparatus as defined in claim 2 further comprising means mounting said wheel assemblies to said chassis so as to permit vertical adjustment of the height of said chassis above the ground surface and thus the depth of the trench formed by said cutter drum.

4. The apparatus as defined in claim 1 wherein said chassis further defines a longitudinal centerline extending between said front and rear ends, and wherein said cutter drum is positioned entirely on one side of said centerline.

5. The apparatus as defined in claim 4 wherein said conveyor means is positioned entirely on said one side of said centerline.

6. The apparatus as defined in claim 5 wherein said cutter drum and said conveyor means are mounted so as to be positioned outside one of said sides of said chassis.

7. The apparatus as defined in claim 1 wherein said cutter drum comprises a cylindrical sleeve which is mounted to said chassis for rotation about said horizontal axis, and a cover plate removably mounted to close an outermost end of said sleeve.

8. The apparatus as defined in claim 7 wherein said enclosure means includes a housing which includes an outer side plate which is in a vertical plane which is parallel to said longitudinal centerline, said outer side plate having an inverted U-shaped opening therein which is sized to lie outside of the circumference of said cutter drum when viewed in side elevation, and an end plate removably mounted to overlie said outer side plate and cover said opening.

9. The apparatus as defined in claim 8 wherein said cover plate of said cutter drum includes a shaft which extends outwardly therefrom along said horizontal axis, and said end plate of said enclosure means includes a bearing sleeve receiving and supporting said shaft therein.

10. The apparatus as defined in claim 1 wherein said cutter drum comprises a cylindrical main body portion which is mounted to said chassis for rotation about said horizontal axis, a cylindrical extension which has a diameter corresponding to that of said main body portion, and means releasably mounting said extension to said main body portion so as to be coaxially aligned with said main body portion along said horizontal axis, and so as to permit the width of the cutter drum to be adjusted.

11. The apparatus as defined in claim 10 wherein both said main body portion and said extension comprises a cylindrical sleeve, and said cutter drum further comprises a cover plate removably mounted to close an outermost end of said extension sleeve.

12. The apparatus as defined in claim 11 wherein said extension of said cutter drum includes helically directed flights on the peripheral surface thereof for guiding the loosened soil axially toward said main body portion of said cutter drum during rotation thereof and to thereby facilitate its delivery onto said conveyor means.

13. The apparatus as defined in claim 11 wherein said enclosure means includes a main housing portion fixedly mounted to said chassis, and a housing extension releasably mounted to said main housing portion for increasing the width thereof when said drum extension of said cutter drum is mounted to said main body portion of said cutter drum.

14. The apparatus as defined in claim 13 wherein said main housing portion includes an outer side plate which is disposed in a vertical plane which is parallel to said longitudinal centerline, said outer side plate having an inverted U-shaped opening therein which is sized to lie outside of the circumference of said cutter drum when viewed in side elevation.

15. The apparatus as defined in claim 14 wherein said housing extension comprises a pair of laterally spaced apart and parallel side walls, with at least one of said side walls of said housing extension having an opening which generally conforms to the outline of the opening in said side plate of said main housing portion, and means releasably mounting said housing extension to said side plate of said housing with said one side wall of said housing extension disposed adjacent said side plate, said mounting means including an end plate which is positioned to overlie an outermost side wall of said housing extension.

16. The apparatus as defined in claim 15 wherein each of said side walls of said housing extension includes an opening which generally conforms to the outline of said opening in said side plate, and wherein said means releasably mounting said housing extension to said side plate further includes bolt means extending between said end plate and said side plate of said main housing portion.

17. The apparatus as defined in claim 1 further comprising deflector means mounted at said outlet end of said conveyor means for deflecting the material being conveyed laterally toward said centerline and thereby facilitate delivery into a truck bed.

18. A self propelled apparatus for digging a shallow trench and removing the soil therefrom along one side of a roadway during forward movement of said apparatus and as part of a roadway widening operation, and comprising a chassis defining a perimeter which includes front and rear ends, and opposite sides, and further defining a longitudinal centerline extending between said front and rear ends, a plurality of wheel assemblies mounted to said chassis for permitting movement along the ground surface, a cutter drum mounted to said chassis so as to be positioned adjacent one of said opposite sides thereof and at least essentially outside of said perimeter of said chassis, and for rotation about a generally horizontal axis which extends between said opposite sides of said chassis and so as to be adapted to engage and dig into the ground surface and form a trench as the apparatus moves forwardly along the ground surface, prime mover means mounted to said chassis for advancing the apparatus in a forward direction and for rotating said cutter drum about said horizontal axis, conveyor means mounted along said one of said opposite sides of said chassis and having an inlet end positioned immediately adjacent said cutter drum and an elevated outlet end positioned beyond one of said ends of the apparatus, and enclosure means enclosing said cutter drum so that the soil which is loosened and removed by the rotating cutter drum is deposited onto said inlet end of said conveyor means.

19. The apparatus as defined in claim 18 wherein said cutter drum is mounted so as to be positioned entirely outside the perimeter of said chassis.

20. The apparatus as defined in claim 18 wherein said cutter drum comprises a cylindrical sleeve which is mounted to said chassis for rotation about said horizontal axis, and a cover plate removably mounted to close an outermost end of said sleeve.

21. The apparatus as defined in claim 20 wherein said enclosure means includes a housing which includes an outer side plate which is in a vertical plane which is parallel to said longitudinal centerline, said outer side plate having an inverted U-shaped opening therein which is sized to lie outside of the circumference of said cutter drum when viewed in side elevation, and an end plate removably mounted to overlie said outer side plate and cover said opening.

22. The apparatus as defined in claim 21 wherein said cover plate of said cutter drum includes a shaft which extends outwardly therefrom along said horizontal axis, and said end plate of said enclosure means includes a bearing sleeve receiving and supporting said shaft therein.

23. The apparatus as defined in claim 18 wherein said cutter drum comprises a cylindrical main body portion which is mounted to said chassis for rotation about said horizontal axis, a cylindrical extension which has a diameter corresponding to that of said main body portion, and means releasably mounting said extension to said main body portion so as to be coaxially aligned with said main body portion along said horizontal axis, and so as to permit the width of the cutter drum to be adjusted.

24. The apparatus as defined in claim 23 wherein said cutter drum comprises a cylindrical sleeve which is mounted to said chassis for rotation about said horizontal axis, and a cover plate removably mounted to close an outermost end of said sleeve.

25. The apparatus as defined in claim 24 wherein said extension of said cutter drum includes helically directed flights on the peripheral surface thereof for guiding the loosened soil axially toward said main body portion of said cutter drum during rotation thereof and to thereby facilitate its delivery onto said conveyor means.

26. The apparatus as defined in claim 24 wherein said enclosure means includes a main housing portion fixedly mounted to said one side of said chassis, and a housing extension releasably mounted to said main housing portion for increasing the width thereof when said drum extension of said cutter drum is mounted to said main body portion of said cutter drum.

27. The apparatus as defined in claim 26 wherein said main housing portion includes an outer side plate which is disposed in a vertical plane which is parallel to said longitudinal centerline, said outer side plate having an inverted U-shaped opening therein which is sized to lie outside of the circumference of said cutter drum when viewed in side elevation.

28. The apparatus as defined in claim 27 wherein said housing extension comprises a pair of laterally spaced apart and parallel side walls, with at least one of said side walls of said housing extension having an opening which generally conforms to the outline of the opening in said side plate of said main housing portion, and means releasably mounting said housing extension to said side plate of said housing with said one side wall of said housing extension disposed adjacent said side plate, said mounting means including an end plate which is positioned to overlie an outermost side wall of said housing extension.

29. The apparatus as defined in claim 28 wherein each of said side walls of said housing extension includes an opening which generally conforms to the outline of said opening in said side plate, and wherein said means releasably mounting said housing extension to said side plate further includes bolt means extending between said end plate and said side plate of said main housing portion.

* * * * *